United States Patent [19]

Hopmann

[11] Patent Number: 4,823,872

[45] Date of Patent: Apr. 25, 1989

[54] DOWNHOLE LOCKING APPARATUS

[75] Inventor: Mark Hopmann, Broken Arrow, Okla.

[73] Assignee: Baker Hughes Incorporated, Houston, Tex.

[21] Appl. No.: 184,833

[22] Filed: Apr. 22, 1988

[51] Int. Cl.[4] ..... E21B 23/03

[52] U.S. Cl. ..... 166/217; 166/382; 285/3

[58] Field of Search ..... 166/86, 87, 125, 181, 166/217, 208, 134, 216, 381, 123, 382; 285/3, 140, 141

[56] References Cited

U.S. PATENT DOCUMENTS

| | | | |
|---|---|---|---|
| 4,043,390 | 8/1977 | Glotin | 166/125 X |
| 4,510,995 | 4/1985 | Krause, Jr. et al. | 166/217 |
| 4,545,434 | 10/1985 | Higgins | 166/125 X |
| 4,595,054 | 6/1986 | Schroeder | 166/217 |

*Primary Examiner*—Stephen J. Novosad
*Assistant Examiner*—David J. Bagnell
*Attorney, Agent, or Firm*—Hubbard, Thurman, Turner & Tucker

[57] ABSTRACT

Apparatus for effecting locking engagement with a well conduit recess comprises a locking tool having radially shiftable locking lugs which are shiftable to a locked position in the conduit recess by downward movement of a lock mandrel. A running tool is secured to the lock mandrel by a plurality of radially shiftable latching elements. Downward movement of the running tool produced by wireline manipulation will effect the downward displacement of the lock mandrel to shift the locking lugs outwardly into engagement with the latching recess; however, the latching elements will not release the lock mandrel from the running tool until full radial engagement of the locking lugs in the conduit locking recess has been achieved.

10 Claims, 3 Drawing Sheets

DOWNHOLE LOCKING APPARATUS

BACKGROUND OF THE INVENTION

1. FIELD OF THE INVENTION

The invention relates to well tools used in the completion of oil and gas wells and more specifically to locking apparatus for positioning well tools, such as safety valves or blanking plugs in nipples within subterranean well conduits, such as tubing strings.

2. DESCRIPTION OF THE PRIOR ART

A common method of positioning a subterranean well tool at a desired position within a well conduit, such as tubing string, is to use a locking apparatus attached to the well tool to anchor the tool in the well. Normally the lock is attached to the top of the well tool and a wireline running tool is attached to the lock to lower the assembly into the well. The lock will normally have an outwardly projecting no-go shoulder for engaging a cooperable no-go shoulder on the nipple to position the lock adjacent to an annular recess defined in the nipple. Outwardly expandable members, such as collets or discrete locking dogs, are employed to engage the annular recess within the nipple. Normally these locking dogs will secure the lock against upward movement while engagement of the no-go shoulders will prevent downward movement of the well tool. The radially expandable members on conventional locking apparatus can then be expanded outwardly by means of springs, by shifting one member to release inherently radially flexible collets, or by axially shifting an inner mandrel beneath the collets or locking dogs to force the radially expandable members outward into engagement with the nipple recess. Interlocking means, such as an enlarged diameter surface on the inner mandrel, can be used to hold the radially expandable members or locking dogs in engaged position.

U.S. Pat. No. 4,510,995 discloses a typical locking tool and is characterized by having locking dogs which carry both upwardly and downwardly directed forces upon full radial expansion thereof into the nipple recess. The expansion of the locking dogs concurrently effects disengagement of the no-go shoulders so that the entire forces subsequently exerted on the lock, either in an upward or downward direction, are absorbed by the engagement of the locking dogs with the nipple recess.

Said U.S. Pat. No. 4,510,995 also discloses a conventional running tool for cooperation with the lock to effect the run-in of the lock to a desired position in the well and the setting of the lock by manipulation of the wireline upon which the running tool is carried. Such running tool relied primarily on shear pins for effecting the necessary interengagement of the running tool with the lock structure and such shear pins were subject to inadvertent breakage whenever obstructions were encountered during the run-in process. Furthermore, the conventional running tool disclosed in said U.S. Pat. No. 4,510,995 has the disadvantage that it is possible, under some circumstances, for the running tool to be actuated by downward jarring to presumably radially expand the locking dogs into engagement with the nipple recess, but the locking dogs are not fully engaged in such recess. Under such conditions, the retrieval of the running tool can be effected but the absence of a complete lock is indicated by the absence of a depending prong on the running tool when it is withdrawn from the well. The fact that an indication of improper setting of the locking dogs has occurred does not really resolve the problem, because a wireline fishing tool has to be lowered into the well to retrieve the partially set locking mechanism and the entire operation then repeated.

The prior art has not provided a running tool which can be retrieved from the well after being manipulated through the lock setting operation without concurrently retrieving the locking tool.

SUMMARY OF THE INVENTION

The invention provides an improved downhole locking tool. Such locking tool conventionally includes a plurality of peripherally spaced, radially shiftable locking dogs and an external no-go shoulder which is engagable with an upwardly facing no-go shoulder defined by a nipple in the well conduit. The same nipple also defines a recess for receiving the locking dogs in locking relationship when such dogs are radially expanded. The locking tool further includes a lock mandrel which is axially movable from a first inoperative position to a second position wherein a camming surface on the mandrel effects the radial expansion of the locking dogs into the nipple recess. Such lock mandrel is provided with a pick-up ring which cooperates with a downwardly facing surface on the body of the locking tool so that when the mandrel is moved upwardly, it will effect an upward movement of the body of the tool.

The running tool for the locking tool of this invention comprises a tubular body element having a downwardly facing surface engagable with the top end of the lock mandrel by downward movement of the tubular body relative to the lock mandrel after the no-go shoulder on the lock body engages the no-go shoulder in the well conduit. The tubular body of the running tool further defines a plurality of peripherally spaced windows for mounting the radially shiftable latching elements. In their radially outward position, such latching elements cooperate with an internal fishing neck profile formed on the upper end of the lock mandrel. The running tool is further provided with an operating sleeve telescopically mounted within the bore of the tubular body. Such sleeve is initially shearably secured at its upper end to the tubular body of the running tool and is provided with external cam or bearing surface engaging the latching elements to hold the same in their outward position in engagement with the fishing neck profile of the lock mandrel. Below the aforementioned camming surface, the external diameter of the operating sleeve is reduced so that downward movement of the tubular body of the run-in tool relative to the operating sleeve will position the latching elements in alignment with the reduced diameter section of the operating sleeve and permit such latching elements to be cammed inwardly to disengage from the fishing neck profile provided on the lock mandrel, after the locking dogs are fully engaged in the conduit recess.

A shoulder on the lower portions of the operating sleeve engages an internal upwardly facing shoulder on the lock body and a shear pin below such shoulder further effects the securement of the operating sleeve of the running tool to the body of the locking tool. Thus, when the no-go shoulder on the locking tool engages the no-go shoulder in the well conduit, the application of a downward jarring force to the running tool will effect the shearing of the shearable connection between the top of the operating sleeve of the running tool and the tubular body of the running tool, but will have no effect on the shear pin. Thus, the tubular body of the running tool can move downwardly in response to the jarring forces, to engage the lock mandrel and shift the lock mandrel downwardly relative to both the body of the locking tool and the operating sleeve of the running tool.

When the lock mandrel has moved downwardly sufficiently to effect the full outward expansion of the locking lugs into fully locking engagement with the nipple recess, the accompanying relative movement of the tubular body of the running tool will have concurrently displaced the latching elements into alignment with the reduced diameter section of the operating sleeve. Thus, the latching elements are released from their position of engagement with the lock mandrel only when the lock mandrel has reached a lowered position corresponding to the full setting of the locking lugs in the nipple recess.

A pick-up C-ring carried within the interior of the tubular body snaps into engagement with an annular external recess provided on the operating sleeve when the latching elements have reached a position of alignment with the reduced diameter section of the operating sleeve. Thus, upward forces applied by wireline to the running tool body will be applied to the operating sleeve.

The running tool can then be released from the locking tool by an upward jarring force which severs the shear pin connection between the operating sleeve of the running tool and the body of the locking tool. The entire running tool can be removed from the locking tool and retrieved to the well surface.

In the event that for any reason, the locking dogs of the locking tool are not fully engaged in the cooperating nipple recess, the position of the lock mandrel and the tubular body of the running tool will be such that the latching elements carried by the running tool will not have released from the fishing neck profile of the lock mandrel. Thus, the application of an upward force to the assemblage will result in the entire assemblage being elevated and withdrawn from the well. This thus accomplishes in one step, what the prior art required two steps to accomplish. Removal of the entire locking tool from the well not only indicates that the locking has not been accomplished but also results in the locking tool arriving at the surface where it may be inspected to determine, if possible, the cause for the failure to lock, without necessitating a separate wireline trip to retrieve the locking tool.

Other advantages of the invention will be readily apparent to those skilled in the art from the following detailed description, taken in conjunction with the annexed sheets of drawings, on which is shown a preferred embodiment of this invention.

DESCRIPTION OF PREFERRED EMBODIMENT

Figure 1:
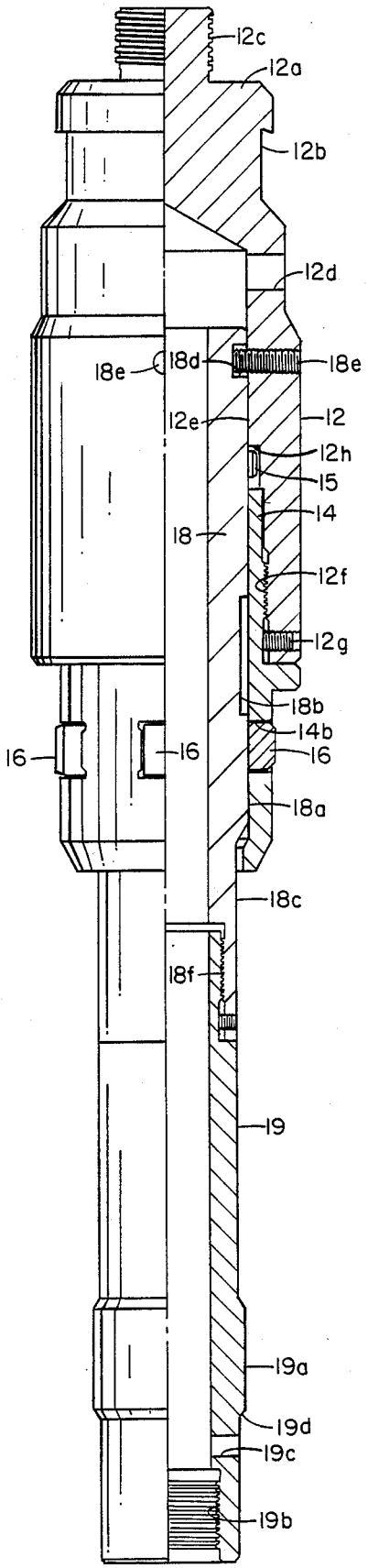
FIG. 1 is a schematic, vertical quarter sectional view of a running tool embodying this invention.

A well locking tool necessarily includes not only the locking tool but a running tool for effecting the wireline insertion of the locking tool in the well conduit and the operation of locking elements carried by the locking tool by wireline manipulation of the running tool after the locking tool has been positioned in the well conduit by bottoming on a no-go shoulder defined in the well conduit. Thus, for simplicity of illustration, the running tool 10 embodying this invention is shown in FIG. 1 separately from the locking tool.

The running tool comprises an upper tubular body portion 12 having a solid upper end portion **12*a* defining a fishing neck 12*b* and an upstanding externally threaded portion 12*c* for conventional engagement by a wireline connector tool (not shown). One or more radial apertures 12*d* communicate the upper portion of the bore 12*e* of the body portion 12 with the annulus surrounding the running tool 10** when it is lowered into the well and when it is positioned at the desired location in the well.

The lower end of the tubular body portion 12 is provided with internal threads **12*f* which receive external threads provided on the upper end of a latch housing 14. These threads are secured by a set screw 12*g***.

A downwardly facing shoulder **12*h* is defined in the bore area 12*e* above the top end 14*a* of the latch housing 14. A contractable retrieving C-ring 15 is mounted in the resulting annular recess for a purpose to be hereinafter described. Those skilled in the art will recognize that the latch housing 14 may, if desired, be made integral with the tubular body portion 12**.

The lower end of the latch housing 14 is provided with a plurality of peripherally spaced windows **14*b*. Latching elements 16 respectively cooperate with the windows 14*b*, with each latching element being prevented from passing outwardly through the windows by a small flange formed on the inner edges of the latching elements 14** but not shown in the drawings.

The latching elements 16 are positioned for run-in as shown in FIG. 1 by an actuating sleeve 18 having a radially enlarged surface **18*a* engaging the inner faces of the latching elements 16. Immediately above and below the enlarged surface 18*a*, the actuating sleeve 18 is respectively provided with recessed surfaces 18*b* and 18*c* for purposes to be hereinafter described. The actuating sleeve 18 is secured in its illustrated position during run-in by a plurality of radially disposed shear screws 18*e* which traverse the wall of tubular housing 12 and engage an annular groove 18*d* formed in the top end of the actuating sleeve 18**.

Actuating sleeve 18 is provided at its lower end with an internally threaded counterbore **18*f* which threadably engages a space-out sleeve 19. Sleeve 19 is provided adjacent its lower end with an enlarged diameter bearing surface 19*a* and with internal threads 19*b*** at its bottom end for threaded connection to a downwardly extending probe (not shown) if required for the particular well installation.

Additionally, a diametrical bore **19*c* is defined in the wall of space-out sleeve 19 below bearing surface 19*d*** to receive a shear pin connection to the locking tool as will be later described.

Figure 2A:
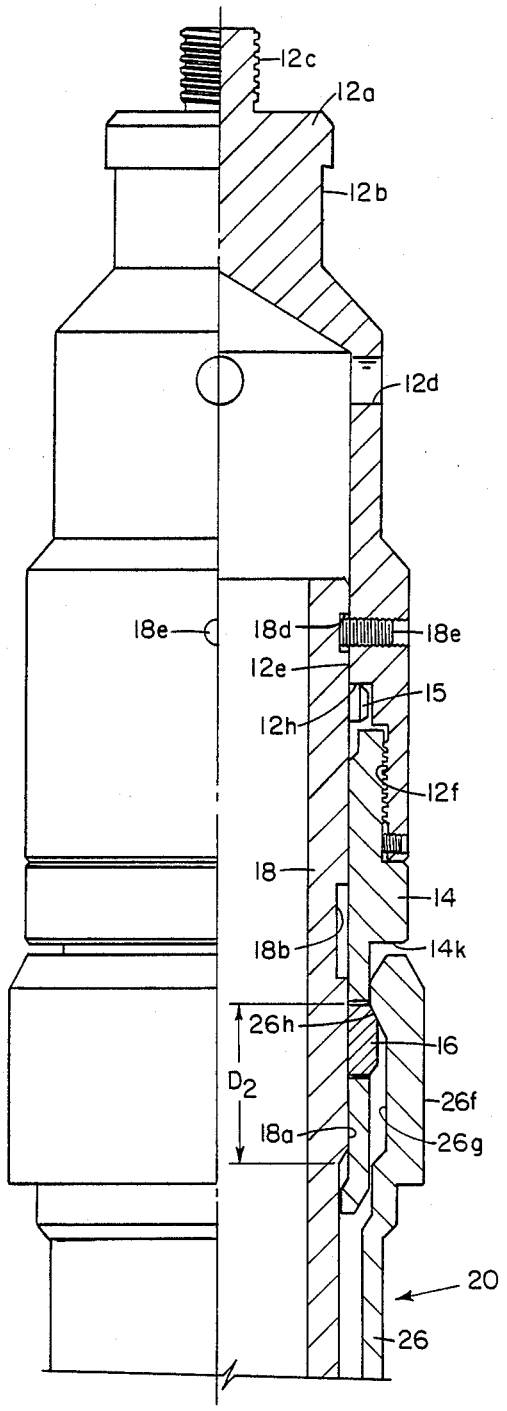
FIGS. 2A and 2B collectively represent a schematic quarter sectional view of a locking tool having the running tool of FIG. 1 inserted therein in position for effecting the run-in of the locking tool.
Figure 2B:
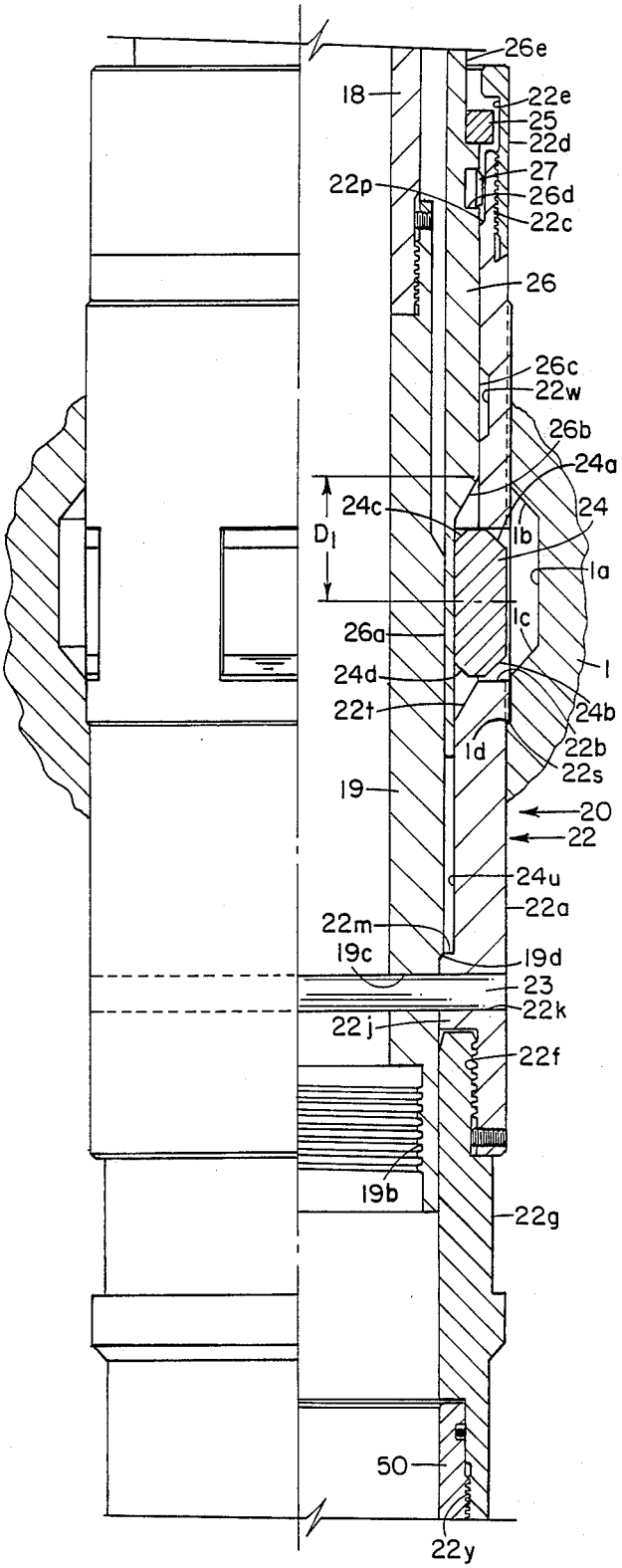
Figure 3A:
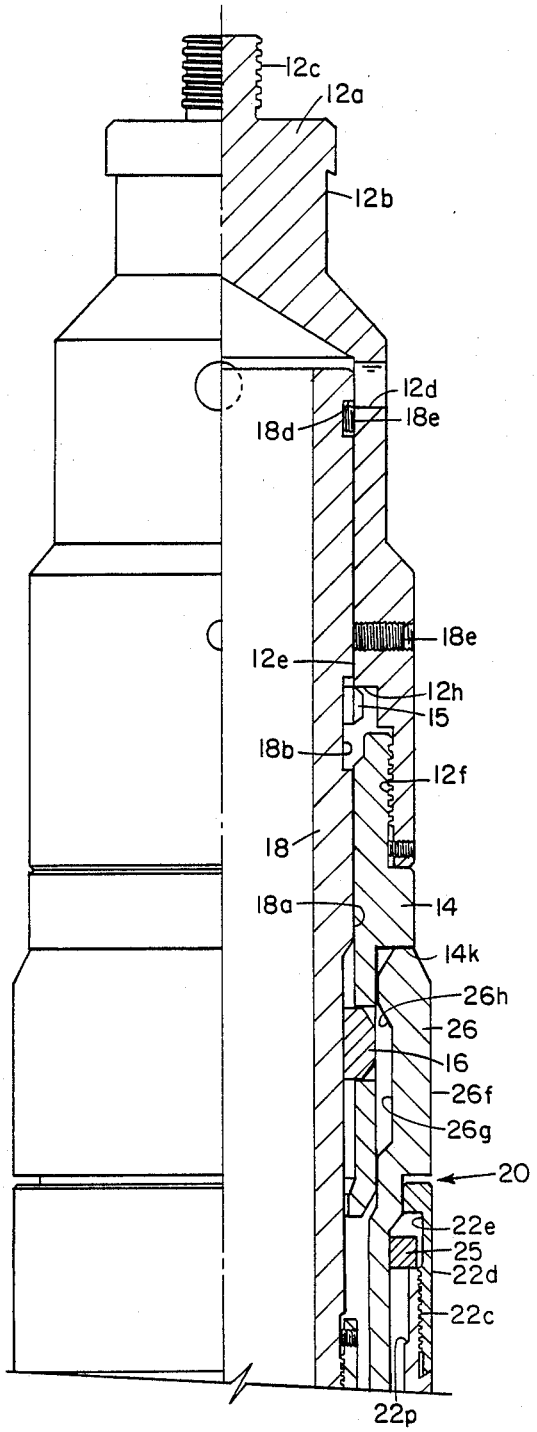
FIGS. 3A and 3B are views respectively similar to FIGS. 2A and 2B, but illustrate the positions of the elements of the locking tool and running tool when the locking tool is fully locked to the well conduit.
Figure 3B:
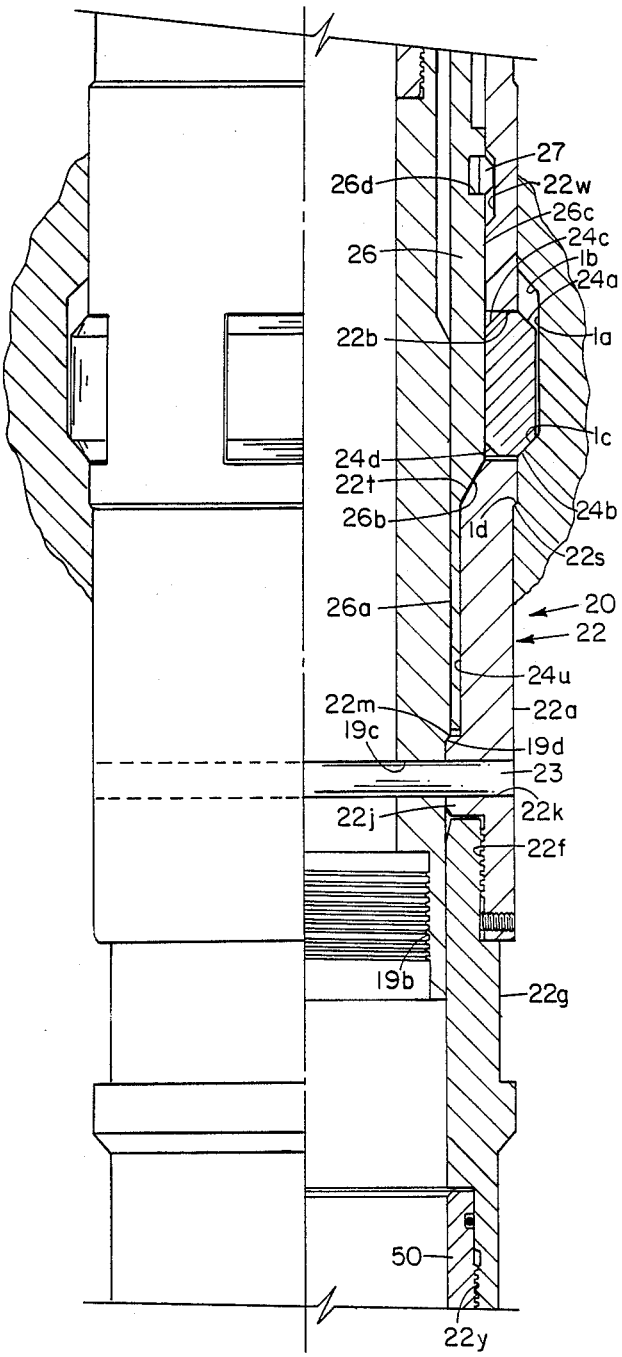

Referring now to FIGS. 3A and 3B, there is shown a locking tool 20 embodying this invention with the running tool inserted therein and secured thereto for run-in purposes. While not limited thereto, locking tool 20 incorporates many of the principal elements of the locking tool shown and described in the aforementioned U.S. Pat. No. 4,510,995, which is assigned to the Assignee of the instant application and the disclosure of which is incorporated herein by reference. Thus, the locking tool 20 includes a tubular outer housing assembly 22 having a medial body portion 22*a* defining a downwardly facing no-go shoulder 22*s* and a plurality of peripherally spaced locking windows 22*b*. The upper end of medial portion 22*a* is threadably secured by threads 22*c* to a retaining ring holder 22*d* which defines an internal recess 22*e* which cooperates with a split ring 25 for retrieval purposes. The lower end of medial portion 22*a* of the locking tool 20 defines internal threads 22*f* which are secured to a space-out sleeve 22*g* which terminates in internal threads 22*y* for connection to whatever tool 50 is to be anchored in the well conduit 1, which is only schematically shown in FIG. 2B.

Medial body portion 22*a* of the outer housing 22 is further provided with an internally enlarged shoulder 22*j*. A diametrical bore 22*k* is formed through the shoulder portion 22*k* and receives a shear pin 23 which also traverses the diametrical bore 19*c* formed in the lower end of the space-out sleeve 19 of the running tool 10. The downwardly facing surface 19*d* of the enlarged shoulder 19*a* on space-out sleeve 19 is in abutment with the upwardly facing surface 22*m* on shoulder 22*j* when the shear pin 23 interconnects the running tool to the locking tool 20. It is accordingly evident that the shear pin 23 cannot be sheared by downward forces applied through wireline manipulation of the running tool, but can only be sheared through the application of an upward force by the wireline manipulation after the locking tool 20 is secured to the well conduit 1 as shown in FIGS. 3A and 3B.

Each of the windows 22*b* in the medial body portion 22*a* receives a locking lug 24. Each locking lug is provided with inclined outer shoulders 24*a* and 24*b* to contour the lug to fit within a locking recess la defined in the well conduit 1. As is well known to those skilled in the art, the locking recess 1*a* by a nipple which is threadably inserted in the well conduit 1. The top and bottom end surfaces 1*b* and 1*c* of the annular recess 1*a* are inclined so as to facilitate the entry and dislodgement of the locking lugs 24 into and out of the locking recess 1*a*.

The locking lugs 24 are prevented from passing completely out of the windows 22*b* by a thin circumferentially extending flange (not shown) provided on the each side of the inner face of each locking lug 24. The internal shoulders 24*c* and 24*d* of each locking lug 24 are inclined or rounded to facilitate the camming action exerted on such lugs by a lock mandrel 26.

Lock mandrel 26 is an elongated tubular element having its lower portion 26*a* telescopically related to the bore 22*u* of the medial body portion 22*a* of the outer housing assembly 22 of the lock 20. In the run-in position of the locking tool 20, the reduced diameter lower portion 26*a* of lock mandrel 26 is disposed in abutment with the inner surfaces of the locking lugs 24. The downwardly facing shoulder 26*b* which interconnects such reduced diameter portion 26*a* with the larger diameter portion 26*c* of the lock mandrel 26 is inclined to effect a camming action on the inclined inner surfaces 24*c* of the locking lugs 24.

At the upper end of the enlarged diameter medial portion 26*c* of the lock mandrel 26, an annular groove 26*d* is provided which cooperates with an expandable C-ring 27 which is secured in position by the top end of the medial body portion 22*a* of the locking tool 20. Locking ring 27 is spring biased to be outwardly contractable and can be contracted by downward movement of the lock mandrel 26 through engagement with an upwardly facing inclined surface 22*p* formed on the interior of the medial body portion 22*a*.

Above the annular groove 26*d*, the lock mandrel 26 is provided with an axially extending external recess 26*e*. This recess permits the lock mandrel 26 to move freely downwardly relative to the retrieving ring 25. Upon upward movement of the lock mandrel 26 relative to the tubular body assembly 22 of the running tool 20, the ring 25 will engage the downwardly facing wall of the retaining sleeve 22*d* and thus move the tubular body assembly 22 upwardly with the lock mandrel 26.

The extreme upper end 26*f* of the lock mandrel 26 is radially enlarged and surrounds the lower end of the latch housing 14 which carries the latching elements 16. In the run-in position of lock tool 20 and running tool 10, the latching elements 16 are displaced outwardly to engage in an internal fishing neck profile 26*g* defined in the extreme upper end portion 26*f* of the lock mandrel 26. Thus, so long as the latching elements 16 are engaged in the fishing neck profile 26*g*, the lock mandrel 26 is secured to the running tool 10. The downwardly facing surface 26*h* at the upper end of the fishing neck profile 26*g* is inclined to exert an inward camming action on the latching elements 16 whenever the tubular body portion 12 of the running tool 10 is moved upwardly relative to the lock mandrel 26.

From the foregoing description, it will be apparent that the running tool 10 is secured to the locking tool 20 for run-in purposes through the interengagement of shoulders 19*d* on the running tool and shoulder 22*m* on the locking tool, together with the interengagement of the latching elements 16 of the running tool 10 with the internal fishing neck profile 26*g* provided on the lock mandrel 26. Any obstructions encountered during the run-in of the combined tools will not exert any shearing forces on the shear pin 23, nor on the shear pin 18*e* which secures the tubular body portion 12 of the running tool 10 to the actuating sleeve 18. Hence, the combined tools may be run into the well on a wireline until the downwardly facing no-go shoulder 22*s* on the locking tool 20 engages the upwardly facing no-go shoulder 1*d* conventionally provided in the well conduit 1. When such engagement occurs, the locking lugs 24 are positioned in alignment with an annular locking recess 1*a* provided in the well conduit 1.

A conventional set of jars (not shown) are incorporated in the wireline and downward jarring forces are then imparted to the tubular body portion 12 of the running tool 10. The first effect of such jarring forces is to shear the shear screws 18*e* which hold the tubular body portion 12 of running tool 10 to the operating sleeve 18. The shearing of these screws will permit the tubular body portion 12 to move downwardly relative to both the operating sleeve 18 and the lock mandrel 26 of the locking tool 20. After a short downward movement, the bottom end surface 14*k* of the tubular body portion 12 of the running tool 10 will move into abutment with the top end of the lock mandrel 26 and force such lock mandrel downwardly relative to the outer housing assembly 22. Such downward force will effect the contraction of the locking C-ring 27 by the upwardly facing, inclined shoulder 22*p* formed on the medial body portion 22*a* of the locking tool 20.

Thus, the downwardly facing, inclined shoulder 26b on mandrel 26 is brought into engagement with the locking lugs 24 and urges such locking lugs radially outwardly into engagement with the locking recess 1a provided in the well conduit 1. Such downward movement of the tubular body portion 12 of the running tool 10 is continued until the enlarged diameter portion 26c of the lock mandrel 26 is moved entirely beneath the locking lugs 24, thereby insuring that such locking lugs are completely seated in the conduit locking recess 1a.

When the leading edge 26b of the enlarged surface 26c of the lock mandrel 26 reaches a position of approximately half the length of the locking lugs 24, the locking lugs 24 will obviously have been fully radially displaced into full engagement with the conduit locking recess 1a. This distance, as indicated on FIG. 2B of the drawings, has the distance D1. The continued downward movement of the lock mandrel 26 will bring the retention C-ring into engagement with an integral recess 22w formed on the medial body portion 22a of the tubular outer housing 22 and thus secure the lock mandrel in its position of full engagement with the locking lugs 24 in their radially expanded position. The limiting downward position of the lock mandrel 26 relative to the outer tubular housing 22 is determined by the engagement of the downwardly inclined surface 26b on the lock mandrel with the upwardly facing surface 22t provided on the medial body portion 22a of the outer tubular housing assembly 22, as shown in FIG. 3B.

As mentioned, the downward movement of the outer tubular housing 12 of the running tool 10 also occurs relative to the operating sleeve 18 of the running tool 10 due to the fact that such operating sleeve is secured by shear pin 23 to the central portion of tubular outing housing 22. Thus, the latching elements 16 are moved downwardly relative to the operating sleeve 18 and are brought into a position of alignment with the smaller diameter recess portion 18c of the operating sleeve 18. The distance required to effect such alignment is shown on FIG. 2A as being the distance D2 and it should be noted that the distance D2 is greater than the downward distance D1 travelled by the lock mandrel 26 to fully set the locking lugs 24 in the conduit recess 1aThis insures that the latching elements 16 will not be released from engagement with the lock mandrel 26 until the lock mandrel 26 has achieved the full radially outer displacement of the locking lugs 24 into the conduit recess 1aFurther downward movement of the locking mandrel 26 to bring the downwardly facing shoulder 26b on the lock mandrel 26 into engagement with the upwardly facing shoulder 22t provided on the outer body assemblage 22 will insure that the latching elements 16 are aligned with recessed surface 18c and limited upward movement of the tubing string will effect the camming of latching elements 16 radially inwardly by virtue of the engagement of the downwardly facing inclined surface 26h formed by the top end of the fishing neck profile 26g with the latch elements 16.

When the latching elements 16 have thus been inwardly displaced, the retrieving C-ring 15 will have been shifted into a position of alignment with the recess 18b and contracts therein, as shown in FIG. 3A. Thus, the operating sleeve 18 is locked against any significant upward movement relative to the tubular housing 12 so that subsequent upward moving of the tubular housing 12 will produce a corresponding upward movement of the operating sleeve 18 and effect the shearing of shear pin 23. After the shearing of such pin, the entire running tool is free to be removed from the locking tool, and hence to be retrieved by wireline to the well surface.

From the foregoing description, it should be readily apparent to those skilled in the art that the combined running tool and locking tool embodying this invention provides greater assurance that the full setting of the locking lugs in the conduit locking recess may be achieved prior to effecting the release of the running tool from the locking tool. Any failure of the locking lugs to fully seat in the locking recess will prevent the latching elements 16 from reaching a position of alignment with the recessed surface 18c of the operating sleeve 18, so that such latching elements will maintain the running tool 10 in secure engagement with the locking tool 20. Thus, in the event of a failure to achieve a locking relationship with the well conduit, the entire running tool and locking tool will be retrieved to the well surface, eliminating the need for running a wireline fishing tool into the well to effect the retrieval of the locking tool.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. For use with a well locking tool insertable in a well conduit and having an external shoulder engagable with a no-go shoulder in the well conduit, radially shiftable lock elements for engaging a conduit recess and an axially shiftable lock mandrel movable from a first position to a second position to radially shift said lock elements into locking engagement with said conduit recess, a run-in tool comprising:

a tubular housing having wireline engagable means on the upper end thereof;

a plurality of peripherally spaced latch windows in the lower portions of said tubular housing;

a plurality of latch elements respectively radially movable relative to said latch windows;

a latch operating sleeve telescopically cooperating with the bore of said tubular housing;

a bearing surface on said latch operating sleeve engagable, in one axial position of said latch operating sleeve, with said latch elements to secure same in a radially expanded position of engagement with the lock mandrel for run-in purposes;

first shearable means securing said latch operating sleeve to said tubular housing in said one axial position;

second shearable means for securing said latch operating sleeve to said locking tool;

said second shearing means being shearable only by upward jarring forces, whereby the application of downward jarring forces to said run-in tool after said locking tool engages said conduit no-go shoulder effects the shearing of said first shearable means and the downward movement of said tubular housing relative to both said lock mandrel and said latch operating sleeve;

a downwardly facing surface on said tubular housing engagable with said lock mandrel to shift same downwardly and thus radially shift said lock elements into the conduit recess; and recess means on said latch operating sleeve below said bearing surface alignable with said latch elements when said lock mandrel is moved by said tubular housing to said second position, thereby permitting disengagement of said latch elements from said well locking tool.

2. The apparatus of claim 1 further comprising means for locking said tubular housing to said latch operating sleeve when said latch elements are aligned with said recess means, thereby permitting wireline retrieval of the entire said run-in tool after shearing said second shearable means by upward jarring forces.

3. The apparatus of claim 1 further comprising means for locking said tubular housing to said latch operating sleeve when said latch elements are aligned with said recess means, thereby permitting wireline retrieval of said run-in tool after shearing said second shearable means by upward jarring forces.

4. A well locking tool insertable in a well conduit having a no-go shoulder and an annular recess adjacent the no-go shoulder comprising, in combination:

a tubular body having an external shoulder engagable with the conduit no-go shoulder;

a plurality of lock elements mounted in said tubular body for radially shiftable movements;

a lock mandrel telescopically mounted in the bore of said tubular lock body for axial movements between a first and second position;

camming means on said lock mandrel for radially shifting said lock elements into engagement with the conduit recess by axial movement of said lock mandrel to said second position; and a run-in tool for said well locking tool comprising;

a tubular housing having wireline engagable means on the upper end thereof;

a plurality of peripherally spaced latch windows in the lower portions of said tubular housing;

a plurality of latch elements respectively radially movable relative to said latch windows;

a latch operating sleeve telescopically cooperating with the bore of said tubular housing;

a bearing surface on said latch operating sleeve engagable in one axial position of said latch operating sleeve with said latch elements to secure same in a radially expanded position of engagement with said lock mandrel for run-in purposes;

first shearable means securing said latch operating sleeve to said tubular housing in said one axial position;

second shearable means for securing said latch operating sleeve to said lock mandrel;

said second shearing means being shearable only by upward jarring forces, whereby the application of downward jarring forces to said run-in tool after said locking tool engages said conduit no-go shoulder effects the shearing of said first shearable means and the downward movement of said tubular housing relative to both said lock mandrel and said latch operating sleeve;

a downwardly facing surface on said tubular housing engagable with said lock mandrel to shift same downwardly and thus radially shift said lock elements in the conduit recess; and recess means on said latch operating sleeve below said bearing surface alignable with said latch elements when said lock mandrel is moved downwardly by said tubular housing to said second position, thereby permitting disengagement of said latch elements from said lock mandrel of the well locking tool.

5. The apparatus of claim 4 further comprising means for locking said tubular housing to said latch operating sleeve when said latch elements are aligned with said recess means, thereby permitting wireline retrieval of said run-in tool after shearing said second shearable means by upward jarring forces.

6. The apparatus of claim 4 wherein said lock mandrel defines an internal fishing neck recess to receive said latching elements, the downwardly facing end surface of said fishing neck recess being inclined to cam said latching elements radially inwardly by downward movement of said lock mandrel, thereby releasing said latching elements from said lock mandrel.

7. The apparatus of claim 4 wherein the distance D1 of downward travel of said lock mandrel required to fully expand said locking dogs is less than the distance D2 of downward movement of said tubular body required to align said latching elements with said recess means, thereby assuring the setting of said locking dogs prior to release of said running tool from said lock mandrel.

8. The apparatus of claim 6 a wherein the distance D1 of downward travel of said lock mandrel required to fully expand said locking dogs is less than the distance D2 of downward movement of said tubular body required to align said latching elements with said recess means, thereby assuring the setting of said locking dogs prior to release of said running tool from said lock mandrel.

9. The apparatus of claim 4 further comprising a C-ring mounted on said lock mandrel and engagable with an annular recess in said locking tool when said lock mandrel has moved downwardly to said second position, thereby locking said lock mandrel in said second position.

10. The apparatus of claim 7 further comprising a C-ring mounted on said lock mandrel and engagable with an annular recess in said locking tool when said lock mandrel has moved downwardly to said second position, thereby locking said lock mandrel in said second position.

* * * * *